US008668005B2

(12) United States Patent
Colon et al.

(10) Patent No.: US 8,668,005 B2
(45) Date of Patent: Mar. 11, 2014

(54) DUMP BAILER

(76) Inventors: Eligio Antonio Colon, Breaux Bridge, LA (US); Grady Geoffroy, Youngsville, LA (US)

( * ) Notice: Subject to any disclaimer, the term of this patent is extended or adjusted under 35 U.S.C. 154(b) by 188 days.

(21) Appl. No.: 13/075,528

(22) Filed: Mar. 30, 2011

(65) Prior Publication Data

US 2012/0247755 A1 Oct. 4, 2012

(51) Int. Cl.
*E21B 27/00* (2006.01)

(52) U.S. Cl.
USPC ..... 166/168; 222/92; 251/129.01

(58) Field of Classification Search
USPC ..... 166/168, 244.1, 165, 286, 63, 332.8, 166/80.1; 222/92; 251/129.01
See application file for complete search history.

(56) References Cited

U.S. PATENT DOCUMENTS 2,141,179 A * 12/1938 Ennis ..... 166/74
3,379,251 A 4/1968 Bohn
5,070,595 A * 12/1991 Perkins et al. ..... 29/602.1
5,392,856 A 2/1995 Broussard, Jr. et al.
6,012,518 A 1/2000 Pringle et al.
6,394,187 B1 * 5/2002 Dickson et al. ..... 166/383
7,201,230 B2 4/2007 Schultz et al.
7,287,591 B2 10/2007 Campbell
2009/0260817 A1 * 10/2009 Gambier et al. ..... 166/285
2011/0155381 A1 * 6/2011 Reaux ..... 166/334.1

* cited by examiner

*Primary Examiner* — Yong-Suk (Philip) Ro
(74) *Attorney, Agent, or Firm* — Law Office of Jesse D. Lambert, LLC

(57) ABSTRACT

A dump bailer for downhole placement of flowable materials in a wellbore. The dump bailer has an elongated housing with a cavity for placement of the flowable materials. The housing has an open bottom. An expendable cap or plug, of a magnetic material, is held within the open bottom by a shear pin, sufficient to hold the plug in place with the material within the cavity. An electric solenoid surrounds the plug. Energizing the solenoid coil by electric current creates a magnetic field which overcomes the shear pin and forces the plug out of the open bottom. The material may then flow out of the cavity. Alternatively, a sliding sleeve may be disposed in the open bottom, which moves from a first closed position to a second open position, in response to the magnetic field.

10 Claims, 2 Drawing Sheets

DUMP BAILER

CROSS REFERENCE TO RELATED APPLICATIONS

Not applicable.

BACKGROUND

In the course of servicing oil and gas wells, it is sometimes necessary to deposit or "dump" materials in a desired downhole location, for example atop a downhole packer. The materials to be dumped may comprise, without limitation, sand, cement, or other generally flowable solids.

The tool used to dump such materials is frequently known in the industry as a "dump bailer." While dump bailers have been in use for many years, and have taken many forms, one common element is that the dump bailer is a generally elongated tool, for running downhole into a wellbore, and has a cavity within which the material to be dumped is placed. The dump bailer is then run downhole (on a cable or wireline, whether an electric wireline or so-called "slickline") to the desired location. The cavity is then opened (by various means), and the material flows out of or dumps out of the cavity due to gravity.

Prior art dump bailers have employed various means of opening the cavity to allow the material therein to flow out, depending upon whether the dump bailer is run on electric wireline, which of course permits actuation of a mechanical means by electric current; or a mechanical means. Mechanical means pose a variety of problems, in that it is frequently not possible to verify depth placement of the tool, and actuating the mechanical means at depth is problematic. Dump bailers for use with electric wireline solve some of these issues, but carry their own problems. Prior art dump bailers for use with electric wireline generally employ some sort of explosive charge to create the required opening into the cavity. Due to the explosive charge, it is of critical importance to avoid a premature actuation of the dump bailer. It is well known that stray electric signals, radio signals, etc. pose a risk of actuating the explosive prematurely. It has therefore long been a practice to require all radio communications to be shut down on oil and gas well work sites when such dump bailer is employed. It is readily understood that this shutdown of communications can pose logistical and even safety issues. Related issues with explosive type dump bailers include the need for federal and/or state explosive licenses; Department of Transportation permits; FAA permits; special explosives training for operators, etc.

SUMMARY

The dump bailer embodying the principles of the present invention yields the advantages of an electrically actuated dump bailer, while avoiding problems in the prior art related to the use of explosive charges and the like, and related to the potential for premature actuation due to stray electric signals and the like. The dump bailer comprises an elongated cylindrical housing with a cavity therein for holding the material to be placed downhole, with one or more openings for flowable material to exit the cavity. A means for blocking the opening is provided. In one embodiment, the opening is an open bottom. The means for blocking the opening is a plug or cap, and the bottom of the cavity is blocked or filled with such expendable plug or cap. The cap is held in place with a means for retaining the cap, sufficient to resist the weight of the material in the cavity. An electric solenoid coil is positioned in operative relationship with the cap, generally surrounding the cap. Once the dump bailer is at the desired downhole location, an electric current from the surface or from a downhole battery energizes the solenoid coil, creating a field of magnetic flux moving the cap (which is of a ferrous or magnetic material) and forcing it in a downhole direction, with sufficient force to overcome the means for retaining the cap in place. With the cap thereby forced out of position and the cavity unplugged, the material within the cavity can simply flow out into the wellbore. Another embodiment uses the electro-magnetic field to force a sliding sleeve downward, thereby opening one or more ports through which the dump material flows out of the cavity.

DETAILED DESCRIPTION

With reference to the drawings, a dump bailer embodying the principles of the present invention may now be described.

Generally, the dump bailer comprises an elongated housing adapted to be run down into a wellbore on an electric wireline. The upper end of the dump bailer (not shown) comprises a wireline head for attachment to the cable, and electrical connectors as appropriate so that electric current may be carried from the surface downhole to the dump bailer. In alternative embodiments, the electric current is from a battery carried downhole proximal the dump bailer. These components are well known in the relevant art.

Figure 1:
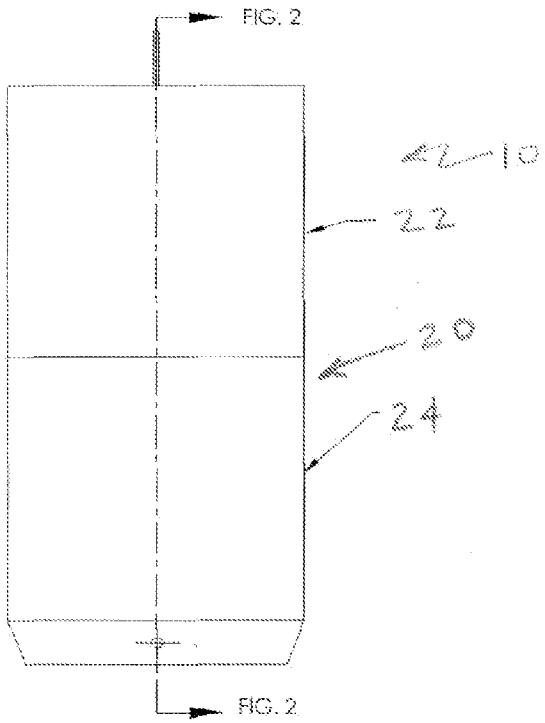
FIG. 1 is a side view of a dump bailer embodying the principles of the present invention.
Figure 3:
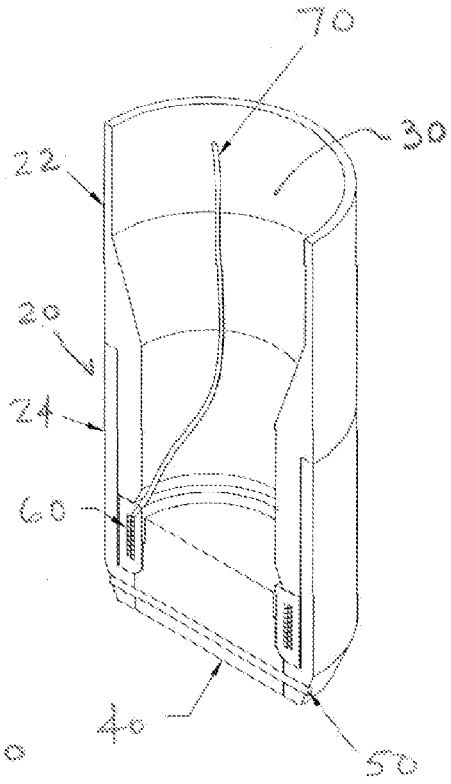
FIG. 3 is a perspective view in cross section of a dump bailer embodying the principles of the present invention.
Figure 2:
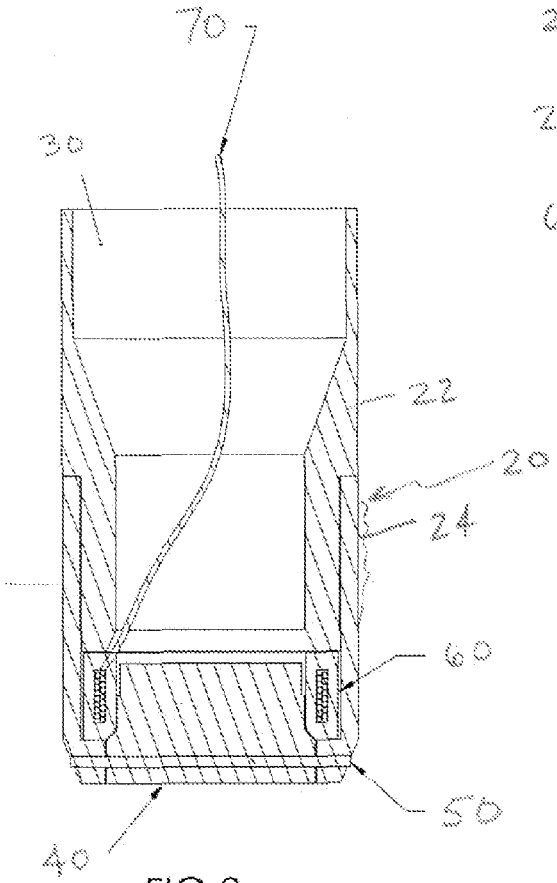
FIG. 2 is a side view in cross section of a dump bailer embodying the principles of the present invention.

FIG. 1 is a side view of the lower end of the dump bailer 10—namely, the end that would be run into the wellbore first. Preferably, dump bailer 10 comprises a housing 20, which may comprise multiple subs, such as top sub 22 and bottom sub 24, which may be connected via a threaded connection. A cavity 30 exists within housing 20. Cavity 30 is sized so as to hold a desired volume of flowable material for placement downhole in a wellbore. Cavity 30 has one or more openings near its lower end, for example an open bottom as can be seen in FIGS. 2 and 3, through which the material can flow. The dump bailer embodying the principles of the invention comprises a means for blocking the opening or openings in cavity 30, so as to maintain materials within cavity 30. In the embodiment shown in FIGS. 2 and 3, the means for blocking the opening comprises a cap 40 disposed in the open bottom, plugging the bottom and preventing the escape of flowable material. A means for retaining cap 40 is provided, for example a shear pin or rod 50. The means for retaining cap 40 may take other suitable forms, such as detents, spring loaded members, etc. The means for retaining cap 40 provides sufficient force to support the weight of the flowable material within cavity 30—i.e. cap 40 cannot be pushed out of place due to the weight of the material.

An electric solenoid coil 60 is disposed proximal cap 40, typically substantially surrounding cap 40, as can be seen in FIGS. 2 and 3. Solenoid coils are well known in the art, as a means for generating a magnetic field by passage of electric current, typically direct current, through the coil. Generally, the solenoid coil comprises a number of coils of wire wrapped around a ferrous core. As a part of the operating principle of an electric coil, the magnetic field thus created imparts a force on any ferrous object within the magnetic field, thereby moving same longitudinally through the coil. Wire 70 connects coil 60 to a source of electric current. Wire 70 may extend to the surface, connecting to a current source at the surface; alternatively wire 70 may connect to a battery carried downhole proximal the dump bailer. In the case of a downhole battery, same is usually run in conjunction with a controller mechanism commonly known as a "memory stick." This controller determines when the electric current is sent from the battery to solenoid 60, and is typically set to trigger solenoid 60 at a specified time when the dump bailer is properly positioned in the hole. As a safety measure, at least one additional condition must exist, for example pressure, to ensure that the solenoid is not activated prematurely (e.g. on the rig floor, or at a shallow depth).

Cap 40 is of a magnetic, namely ferrous, material. As can be understood from the preceding description of the function of a solenoid coil, once energized the cap will be forced downward due to the action of the magnetic coil. Solenoid coil exerts sufficient force to overcome the restraining force of the means for retaining cap 40 in place, for example sufficient force to shear pin 50. The combination of the force exerted by solenoid coil 60, and the weight of the material within cavity 30, forces cap 40 out of place, so that the material within cavity 30 can flow out into the desire location in the wellbore.

Figure 5:
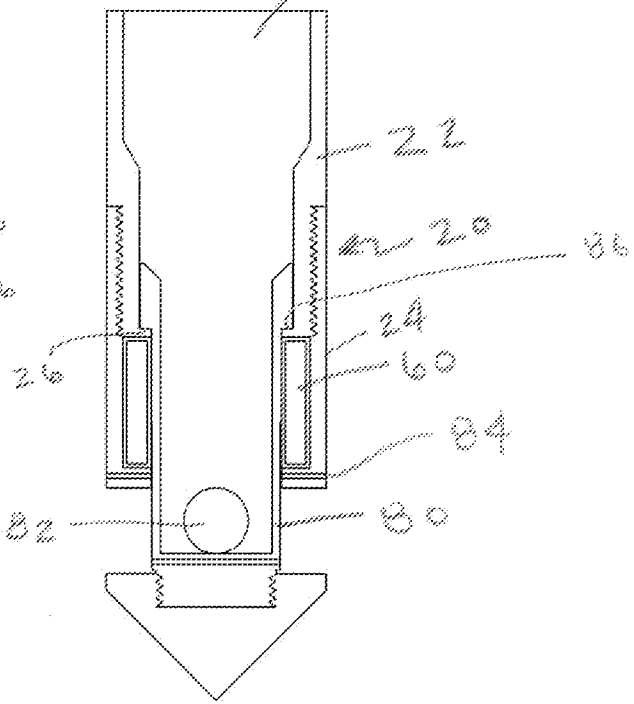
FIGS. 4 and 5 are side views in cross section of another dump bailer embodying the principles of the present invention, namely a retrievable dump bailer.
Figure 4:
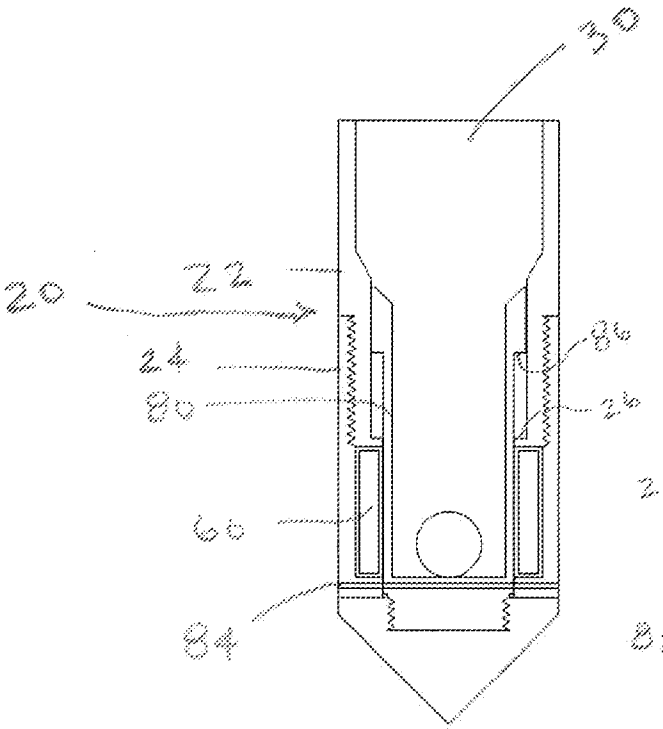

Another embodiment of the dump bailer comprises a sliding sleeve controlling flow of material out of cavity 30. With reference to FIGS. 4 and 5, this embodiment also comprises housing 20 having cavity 30 therein, and solenoid 60 around the open lower end of cavity 30. A sleeve 80, which may have one or more openings 82, is slidably disposed within housing 20, movable between a first position shown in FIG. 4, wherein cavity 30 is closed off, by virtue of openings 82 being disposed within housing 20; and a second position shown in FIG. 5, wherein openings 82 are moved out of housing 20 and exposed. Flowable material in cavity 30 can then flow out of cavity 30, through openings 82. At least a portion of sleeve 80 is of a magnetic material, which moves in response to a magnetic field created by electric solenoid 60, thereby shifting sleeve 80. It is understood that sleeve 80 is initially held in the first (closed) position as in FIG. 4, by a means for retaining sleeve 80 in the first position, element 84, which (as in the earlier embodiment) may be a shear pin or rod. Also, as can be seen in FIGS. 4 and 5, a means for retaining sleeve 80 within housing 20 is provided, preferably by interfering contours, such as shoulders 26 and 86 on housing 20 and sleeve 80, respectively.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example:

- dimensions of the dump bailer may be varied to suit particular applications
- different materials may be used to fabricate various parts of the dump bailer, including but not limited to high strength steels and alloys, iron, copper or similar materials for wiring, etc.
- the opening or openings through which the flowable material exits the cavity may be placed at the bottom of the cavity, creating an open bottom end; or alternatively may be placed in the side wall of the housing, preferably near the bottom end of the cavity.

Therefore, the scope of the invention is to be determined not by the illustrative examples set forth above, but by the appended claims and their legal equivalents.

We claim:

1. A dump bailer, comprising:

a housing having a hollow cavity therein, said cavity having an open bottom through which flowable materials within said cavity can flow out;

an electric solenoid coil disposed in proximal relationship with said housing, and connected to a source of electric current;

a cap inserted into said open bottom in said cavity, responsive to energizing of said electric solenoid coil by passage of electric current therethrough, whereby as said coil is energized said cap moves and said open bottom is opened, wherein said cap is moved out of said open bottom and detached from said housing; and a means for retaining said cap in place and blocking said opening as said coil is not energized.

2. The dump bailer of claim 1, wherein said means for retaining said cap in place within said open bottom comprises a shear pin.

3. The dump bailer of claim 1, wherein said source of electric current is disposed at the surface of a well.

4. The dump bailer of claim 1, wherein said coil is positioned so as to encircle said cap.

5. The dump bailer of claim 1, wherein said electric current is direct current.

6. A dump bailer for placement of flowable solids material downhole in a wellbore, comprising:

an elongated cylindrical housing having an open bottom and a cavity therein;

an electric solenoid coil disposed around said open bottom of said housing, said electric coil connected to a source of electric current; and a cap insertable into said open bottom of said housing, and a means for retaining said cap in position while a volume of flowable material is disposed within said cavity, said cap responsive to a magnetic field created by energizing of said electric solenoid coil such that a force arising from said magnetic field overcomes said means for retaining said cap in position and moves said cap out of said open bottom, wherein said cap is detached from said housing, whereby said flowable material flows from said cavity.

7. The dump bailer of claim 6, wherein said cap is of a magnetic material.

8. The dump bailer of claim 6, wherein said means for retaining said cap in position is a shear pin.

9. The dump bailer of claim 6, wherein as said cap is moved from said open bottom, said cap falls into said wellbore.

10. A dump bailer for placement of flowable solids material downhole in a wellbore, comprising:

an elongated cylindrical housing having an open bottom and a cavity therein, said cylindrical housing disposed downhole in a wellbore on a wireline;

an electric solenoid coil disposed around said open bottom of said housing, said electric coil connected to a source of electric current; and a cap inserted into said open bottom of said housing, a means for retaining said cap in position, and a volume of flowable material disposed within said cavity, said cap responsive to a magnetic field created by energizing of said electric solenoid coil such that a force arising from said magnetic field overcomes said means for retaining said cap in position and moves said cap out of said open bottom, wherein said cap is detached from said housing, whereby said flowable material flows from said cavity.

* * * * *